US009343828B2

(12) United States Patent
Bishop

(10) Patent No.: US 9,343,828 B2
(45) Date of Patent: May 17, 2016

(54) PUSH BUTTON POWER POKE HOME CONNECTOR

(71) Applicant: AVX Corporation, Myrtle Beach, SC (US)

(72) Inventor: Peter Bishop, Cambridgeshire (GB)

(73) Assignee: AVX CORPORATION, Myrtle Beach, SC (US)

( * ) Notice: Subject to any disclaimer, the term of this patent is extended or adjusted under 35 U.S.C. 154(b) by 99 days.

(21) Appl. No.: 14/221,585

(22) Filed: Mar. 21, 2014

(65) Prior Publication Data

US 2015/0270626 A1 Sep. 24, 2015

(51) Int. Cl.

| | |
|---|---|
| ***H01R 4/48*** | (2006.01) |
| ***H01R 12/82*** | (2011.01) |
| *H01R 43/20* | (2006.01) |
| *H01R 4/22* | (2006.01) |

(52) U.S. Cl.

CPC ..... *H01R 4/4818* (2013.01); *H01R 4/4836* (2013.01); *H01R 12/82* (2013.01); *H01R 4/22* (2013.01); *H01R 43/20* (2013.01); *Y10T 29/4922* (2015.01)

(58) Field of Classification Search

CPC .... H01R 4/4836; H01R 4/4818; H01R 12/82; H01R 4/22

USPC ..... 439/816, 835, 660

See application file for complete search history.

(56) References Cited

U.S. PATENT DOCUMENTS

| | | | | |
|---|---|---|---|---|
| 6,280,233 | B1 * | 8/2001 | Beege | H01R 4/4827 439/441 |
| 6,851,967 | B2 * | 2/2005 | Miyoshi | H01R 4/4836 439/441 |
| 8,979,573 | B1 * | 3/2015 | Barber | H01R 4/4836 439/441 |
| 9,136,614 | B2 * | 9/2015 | Sasano | H01R 4/4827 |
| 2004/0116001 | A1 * | 6/2004 | Lenker | H01R 4/4836 439/835 |

* cited by examiner

*Primary Examiner* — Khiem Nguyen

(74) *Attorney, Agent, or Firm* — Foley & Lardner LLP

(57) ABSTRACT

An apparatus includes an insulated body, a conductive contact disposed in the insulated body, and a button disposed on the insulated body. The insulated body can receive a wire through an opening in the insulated body. The conductive contact contacts the wire and secures the wire through a compression force exerted on the wire. The button has a neutral position and a depressed position, and the button in the depressed position is configured to reduce the compression force exerted on the wire.

14 Claims, 8 Drawing Sheets

PUSH BUTTON POWER POKE HOME CONNECTOR

BACKGROUND

Various types of connectors are used for forming connections between two wires or between a wire and an electronic component. For example, connectors may be used in the telecommunications industry and in printed circuit board (PCB) applications. In residential applications, certain connectors may be used to terminate a wire. Some of these locations where terminated wires are used could include lighting systems and components, power outlets and receptacles, circuit breakers, fuse boxes, power panels, and utility systems and components. Other applications such as industrial and commercial settings also require terminating wires at various places to supply power, control, and instrumentation to various systems and components throughout a structure.

A further application of wire connectors is in connecting one wire to another wire. For example, a light fixture may be packaged from a factory with pre-installed wiring. The pre-installed wiring may not be long enough to terminate the wire at a power panel; therefore a wire to wire termination may be used to add extra wire length. In this manner, the light fixture may then be connected to a power panel or other power source more easily.

SUMMARY

In accordance with an illustrative embodiment, an apparatus includes an insulated body, a conductive contact disposed in the insulated body, and a button disposed on the insulated body. The insulated body can receive a wire through an opening in the insulated body. The conductive contact contacts the wire and secures the wire through a compression force exerted on the wire. The button has a neutral position and a depressed position, and the button in the depressed position is configured to reduce the compression force exerted on the wire.

In accordance with another illustrative embodiment, an apparatus includes an insulated body, a conductive contact disposed in the insulated body, and a button disposed on the insulated body. The insulated body can receive a wire through an opening in the insulated body. The conductive contact contacts the wire, secures the wire through a compression force exerted on the wire, and electrically connects the wire to an electrical component. The button has a neutral position and a depressed position, and the button in the depressed position is configured to reduce the compression force exerted on the wire.

An illustrative method of manufacture includes forming a body of insulating material, forming a button of insulating material, forming a conductive contact, inserting the button into the opening for receiving the button, and inserting the conductive contact into the opening for the conductive contact. The body has an opening for receiving a wire, an opening for receiving a conductive contact, and an opening for a button. The button has a main portion and at least one prong portion. The prong portion has a first prong section having a first width and a second prong section extending from the first prong section. The second prong section has a second width, and the second width is greater than the first width. The conductive contact has a U-shape, and the U-shape has a first end, a second end, and a base portion connected to the first and second end. There is a groove in the first end of the U-shape.

BRIEF DESCRIPTION OF THE DRAWINGS

Illustrative embodiments will hereafter be described with reference to the accompanying drawings.

DETAILED DESCRIPTION

Reference will now be made to various embodiments, one or more examples of which are illustrated in the figures. The embodiments are provided by way of explanation of the invention, and are not meant as a limitation of the invention. For example, features illustrated or described as part of one embodiment may be used with another embodiment to yield still a further embodiment. It is intended that the present application encompass these and other modifications and variations as come within the scope and spirit of the invention.

Described herein are illustrative electrical connectors for use in applications such as power circuits. When terminating wires, either to each other or to an electronic component, it is worthwhile for such a termination to be easy to perform. Illustrative connectors as disclosed herein may be used to terminate a wire easily and quickly. Further, the illustrative connectors allow the wire to be held securely as a result of the termination. If a wire is not terminated securely, a short may occur causing damage, or at least causing malfunctioning wire systems and electrical components. Thus, the illustrative connectors disclosed herein also secure a terminated wire to prevent such issues. Additionally, illustrative connectors disclosed herein may incorporate a push button release, which allows de-termination of wires in a simple and effective way. By pressing on the push button, a securely terminated wire is released without requiring excessive force or damaging the wire. The wire may also be easily terminated and de-terminated more than once, because the push button connector will not damage the wire during termination or de-termination.

Various illustrative embodiments of an electrical connector are illustrated in FIGS. 1 through 8B.

Figure 1:
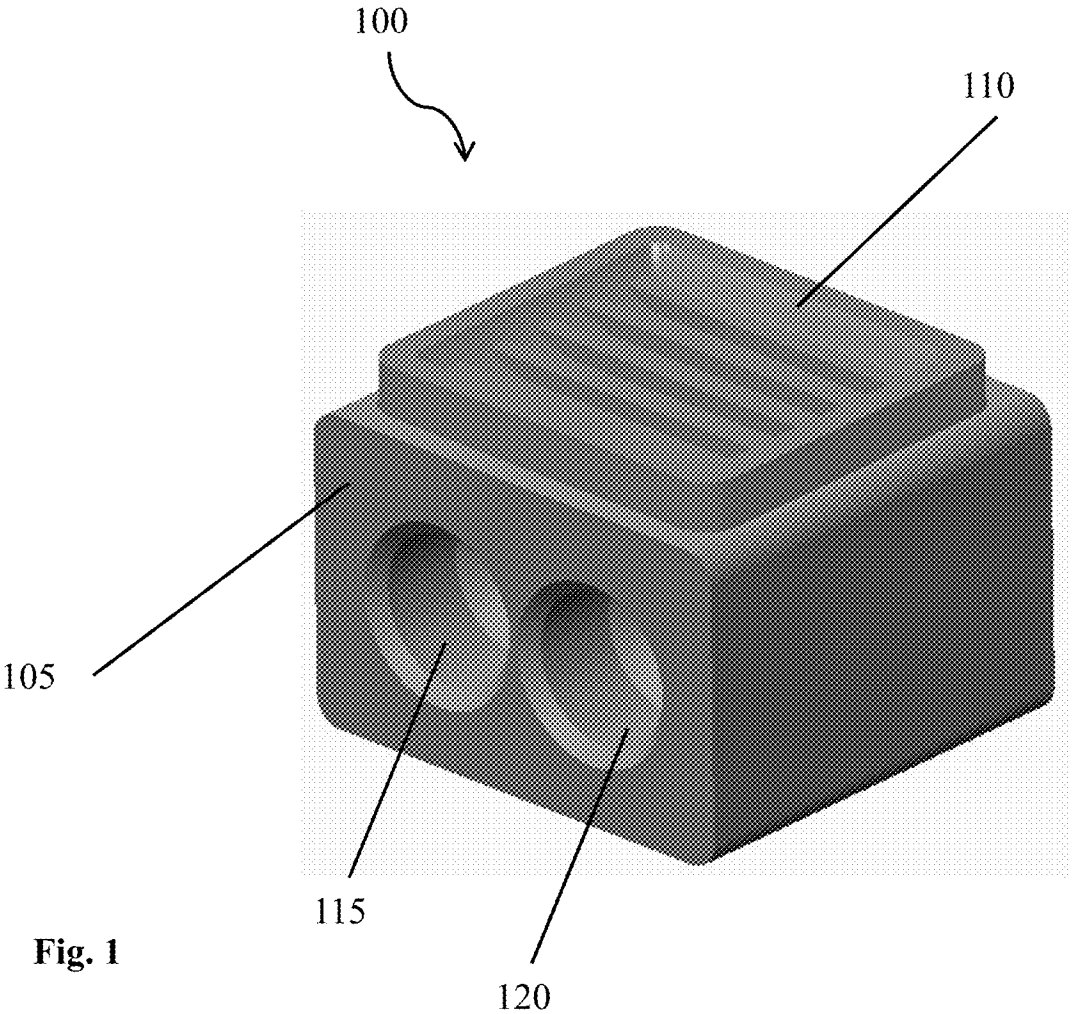
FIG. 1 depicts a perspective view of a push button power poke home connector in accordance with an illustrative embodiment.

In a first illustrative embodiment, shown in FIG. 1, a perspective view of a push button power poke home connector 100 is shown. The connector 100 has an insulated body 105 and a push button 110. The insulated body 105 has a first opening 115 and a second opening 120. Opening 115 and opening 120 can receive a wire. A wire can be pushed into the opening 115 and is then terminated inside the insulated body 105. How the wire may be terminated will be shown in proceeding illustrative embodiments. In an embodiment, a terminated wire inserted into opening 115 is electrically connected to any wire terminated in opening 120. When a wire is inserted into the opening 115 or opening 120, the button 110 can be pressed. Pushing down on button 110 when terminating a wire in opening 115 or opening 120 makes it easier to insert the wire into opening 115 or opening 120. In other words, the force needed to complete a termination of a wire is reduced when button 110 is pressed. A termination can still be completed without pressing button 110, although it may require more force to insert the wire.

Further, when using connector 100, any wire that is already terminated can be easily removed, or de-terminated. The button 110 can be pressed which allows a wire inserted into opening 115 or opening 120 to be easily removed. A wire may be removed without pushing button 110, but it would require significantly more force to do so. After de-terminating a wire from opening 115 or opening 120, the connector 100 can be used again, with the same wires or different ones. In the same way, a wire that is de-terminated from connector 100 can be used again in another connector.

In another illustrative embodiment, a connector may have more or less than two openings. For example, if there are several wires that can all be terminated together, a connector may have three, four, five, six, or more openings. One example of this may be for a ground bus in a lighting system. In order to ground all circuits in a lighting system, ground wires could all be terminated together in such a connector that has several different openings, where the wires in each opening are all electrically connected after termination into the connector. Additionally, it should be noted that different embodiments of connectors disclosed herein can be made to accommodate wires of different sizes and types.

In other illustrative embodiments, the wires terminated in the same connector may not all be electrically connected within the connector. For example, a connector with four openings may electrically connect wires terminated in the first and second openings. The connector may also electrically connect wires terminated in the third and fourth openings. In another illustrative embodiment, a connector may electrically connect wires to an electrical component instead of another wire inserted in the connector. Such an electrical component could be a control system, a circuit breaker, a circuit board, a sensor, a light, a switch, a power receptacle, a motor, a control panel, a computer, a processor, an electronic display, an actuator, or any other suitable electrical component.

In other embodiments of the connector 100, the button 110 may be a certain color which represents what type of wire should be inserted in the connector 100. The insulated body 105 could also be a certain color that indicates the use of the connector 100. For example, the button 110 may be green if the wires connected in the connector 100 are also connected to ground. Further either, the button 110 or the insulated body 105 could have letters, numbers, symbols, or a combination of letters, numbers, and symbols to indicate the type or identity of wires connected in the connector 100.

Figure 2:
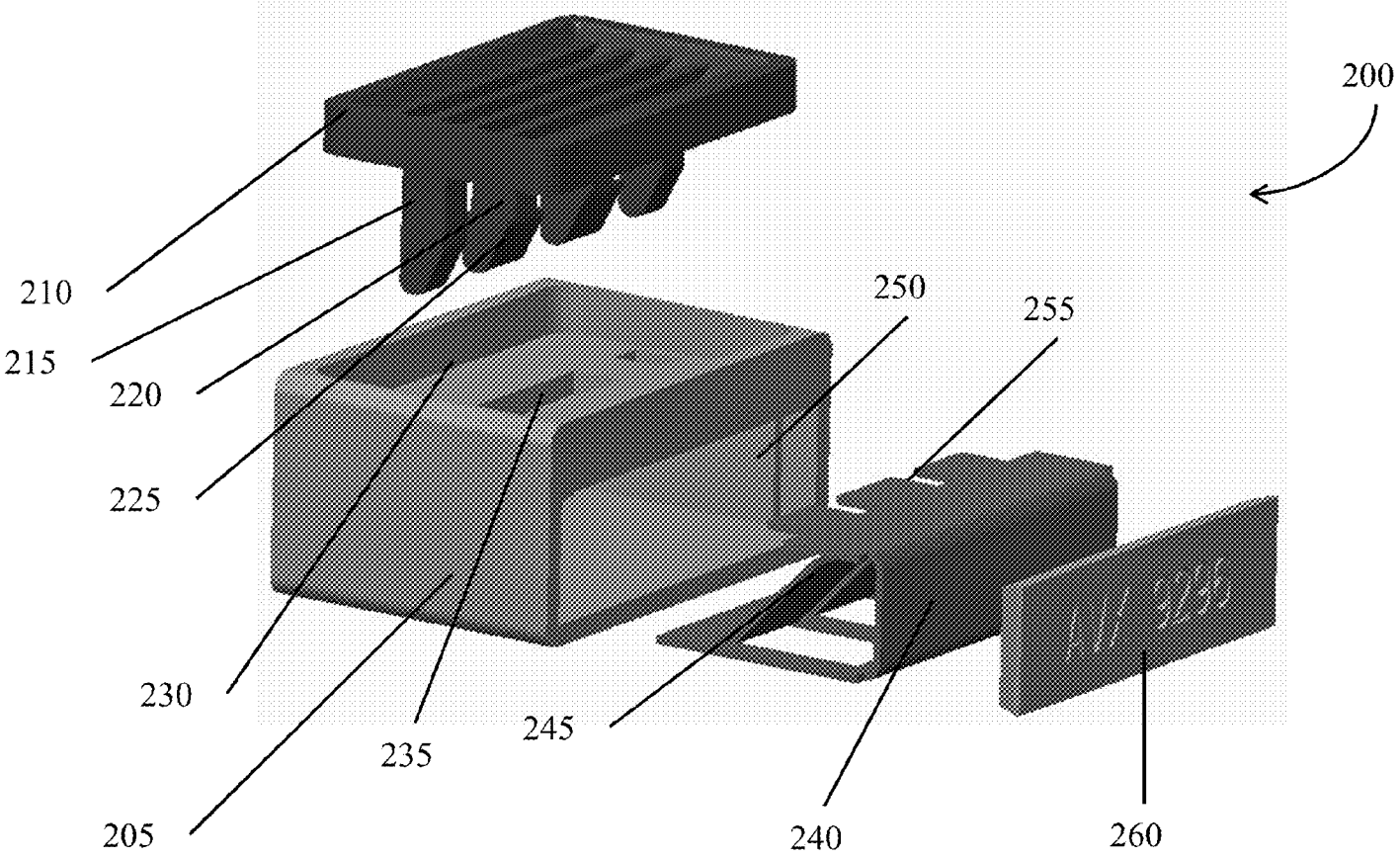
FIG. 2 depicts an exploded perspective view of a push button power poke home connector in accordance with an illustrative embodiment.

In an illustrative example, FIG. 2 shows an exploded view of a connector 200 incorporating a push button release. The connector 200 includes an insulated body 205 and a button 210. The button 210 has a prong 215 that extends down from the main section of the button 210. Here, the button 210 is an insulating material. In this embodiment, the button 210 has four prongs that extend down, as shown in FIG. 2. In this embodiment, two of the four prongs have sections with varying widths. This is shown by prong section 220, which has a smaller width than prong section 225. As will be discussed below, the difference in widths of prong section 220 and prong section 225 will assist in securing all the pieces of connector 200 together, while allowing the button 210 to move up and down and effectuate the push button aspect of the connector.

The button 210 fits into a slot 230 in the insulated body 205. The prong sections, including prong 215, fit into additional slots in the insulated body 205. For example, the prong with prong section 225 fits into a slot 235 in the insulated body 205. Both the slot 230 and the slot 235 allow the button 210 freedom to move up and down within the insulated body 205.

Connector 200 also includes a contact 240. The contact 240 is made of electrically conductive material. The contact 240 in this embodiment is generally U-shaped. The contact 240 generally has a first end, a second end, and a base portion. In other embodiments, alternative shapes for contact 240 are possible. The contact 240 can fit into the insulated body 205 through slot 250. The contact 240 includes an angled contact portion 245. This angled portion is a cutout portion of the second end of the general U-Shape. The angled contact portion 245 is cut from the second end, and bent upward toward the first end of the contact 240. When the connector 200 is assembled, the angled contact portion 245 can be contacted by the prong 215 of the button 210. When the button 210 is pushed down, the angled contact portion 245 will in turn be deflected or pushed downward toward the bottom of the connector 200. Similarly, if the button 210 is released, the angled contact portion 245 will return to the position shown in FIG. 2. Further figures and discussion regarding the operation and configuration of the angled contact and push button operation can be found below.

The contact 240 also includes a groove 255. In an embodiment, the groove 255 is present in the first end of the contact 240. The narrower width prong section 220 can fit into groove 255 when the connector 200 is assembled. The relatively wider prong section 225 cannot fit into the groove 255. As will be discussed below, this allows the button 210 to move up and down, while also securing the button within the connector 200.

The connector 200 also includes a cap 260. The cap 260 fits into the slot 250 in the insulated body 205. The cap 260 is made of an insulating material. The cap 260 helps secure the contact 240 within the insulated body 205. The cap 260 also prevents electrically conductive material like the contact 240 from being exposed. In an embodiment, the cap 260 may have some sort of identifier on it, as shown in FIG. 2.

In other embodiments, the cap 260 may be omitted, or it may be modified in some way to allow the connector 200 to connect to an electrical component. In further embodiments, the contact 240 may be part of an electrical component, or the contact of an electrical component itself. The contact 240 may also be more than one piece in other embodiments. The contact 240 may also have varying shapes. The U-shape of contact 240 may be rounded or square on the corners. In another embodiment, the U-shape may not have corners and may be a continuous curve or arc. In some embodiments the first and second end of the U-shape may have different lengths. In another embodiment the first and second end of the U-shape may have the same lengths. In still further embodiments, a contact that does not have a U-shape at all may be used. Additionally, a combination of separately formed contacts may be used to affect the same results. In another embodiment, the insulated body 205 and the button 210 may be formed at the same time as one piece of insulating material. In such an embodiment, the top button 210 may be attached to the insulated body 205 at one side, and the button 210 would move on an axis where it is attached to the insulated body 205, rather than a straight up and down (i.e., vertical) movement.

Figure 3:
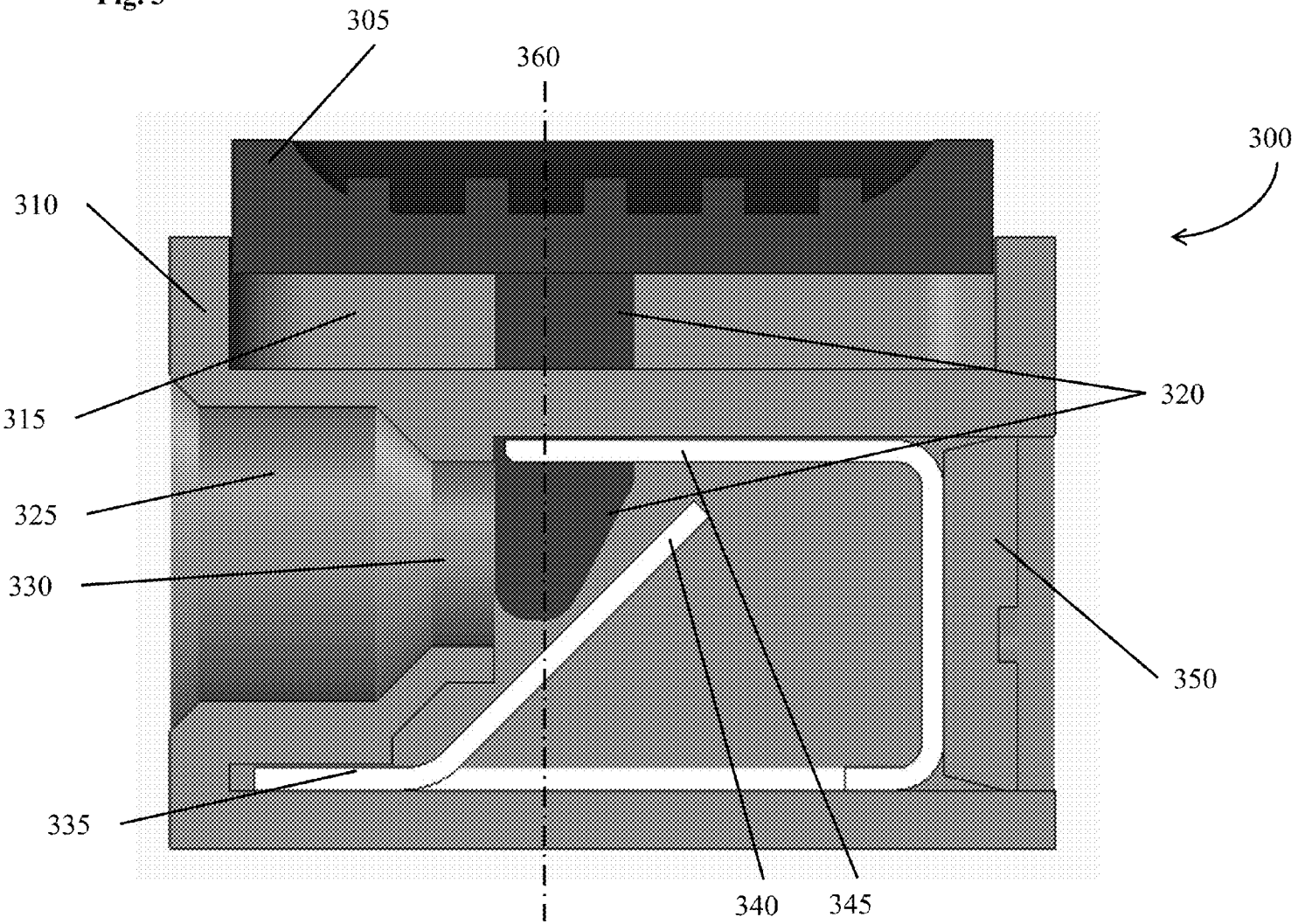
FIG. 3 depicts a cross-sectional view of a push button power poke home connector in accordance with an illustrative embodiment.

In an illustrative example, FIG. 3 shows a cross-sectional view of a connector 300 incorporating a push button release. The connector includes an insulated body 310 and a button 305. The button 305 fits into a slot 315 in the insulated body 310. The slot 315 allows the button 305 to move up and down within the insulated body 310. The button 305 includes a prong 320. Other prongs may be attached to the button 305, but only prong 320 is visible here. Prong 320 extends down into the insulated body 310 through a slot for the prongs that is not visible in FIG. 3. The prong 320 is therefore free to move up and down along with the button 305.

The connector 300 also includes a contact 335. The contact 335 includes an upper portion 345 and an angled portion 340. The upper portion 345 includes a slot that is not visible in this view. The slot accommodates the prong 320, and allows it to move up and down along with the button 305.

The insulated body 310 includes an opening 325. The opening 325 allows a wire to be inserted into the insulated body 325. In this particular embodiment, the opening 325 includes a reduced opening 330 further within the insulated body 310. This configuration allows a wire with insulation to be easily and securely inserted into the opening 325. After a wire with insulation is stripped, only a section at the end of the wire will be lacking insulation. This section without insulation will extend into the reduced opening 330 and further into the insulated body 310 toward the contact 335. The part of wire that still has insulation can be inserted into the wider opening 325. This can allow for a safe and efficient insertion of wire into connector 300. If the connector does not accommodate wire with insulation, it may allow exposed wire to exist outside of the insulated body 310.

When a wire is inserted into the opening 325 and the reduced opening 330, it extends into the insulated body 310 toward the contact 335. It does not necessarily impact the prong 320, as prong 320 is offset from the reduced opening 330 so as to not interfere with an inserted wire. This will be evident from other figures to be discussed below. In particular the wire will extend toward the upper portion 345 and the angled portion 340 of the contact 335. The angled portion 340 of the contact 335 is designed to be flexible. The angled portion 340 is also substantially elastic in this embodiment. In other words, when a wire is inserted it is pushed in between the angled portion 340 and the upper portion 345. The angled portion 340 can deflect to accommodate the inserted wire, and it exerts a force on the wire (when the wire is inserted) that presses it up against the upper portion 345. Since the angled portion 340 is elastic, it will generally return to the configuration as shown in FIG. 3 without a wire. When the wire is originally inserted, the force from inserting the wire itself can be the force which causes the angled portion 340 to deflect. Since the angled portion 340 is angled in the direction the wire would be inserted, it allows the wire to be inserted without too much force, but prevents the wire from being easily removed after it has been inserted.

As noted above, a wire can be inserted into the opening 325 and the opening 330 without pushing the button 305. However, the wire can also be inserted while the button 305 is depressed. This will allow the wire to be inserted with even less force. This may be particularly useful for smaller wires that may bend easily when inserted and contacting the angled portion 340. When button 305 is depressed, the prong 320 will press down on the angled portion 340, causing it to deflect or bend away from the upper portion 345. This may allow a wire to be inserted into the gap between the angled portion 340 and the upper portion 345 with little or no force. When the button 305 is then released after insertion of the wire, the angled portion 340 will then attempt to resume its original position as shown in FIG. 3. The wire will prevent the angled portion 340 from completely returning to its original position, which will cause the angled portion 340 to exert a force on the wire, holding the wire in place between the angled portion 340 and the upper portion 345. Such a configuration will also allow for electrical connectivity between the wire and the contact 335.

When an inserted wire is to be removed from the connector 300, the button 305 may be depressed causing the prong 320 to press down on the angled portion 340 of the contact 335. This will release the force exerted on the wire and allow removal of the wire from the opening 325. It may be possible to remove an inserted wire from the connector 300 without depressing the button 305, but it would require significantly more force than if the button 305 is depressed.

In the embodiment shown in FIG. 3, the prong 320 is not touching the angled portion 340. In other embodiments, the prong 320 may normally rest on the angled portion 340. In such an embodiment, the angled portion 340 could hold the prong 320, and in turn the entire button 305, in place. Thus, the prong 320 would always be engaged with the angled portion 340, providing stability for the button 305 and causing the button 305 to return to a particular position when the button 305 is released or a wire is removed from the connector 300.

The connector 300 also includes a cap 350. The cap 350 can be located in the insulated body in order to hold the connector 335 in place and also prevent the contact 335 from being exposed at the back of the insulated body 310. In other embodiments, the cap 350 may not exist and may be an integrated part of the insulated body 310.

Figure 4:
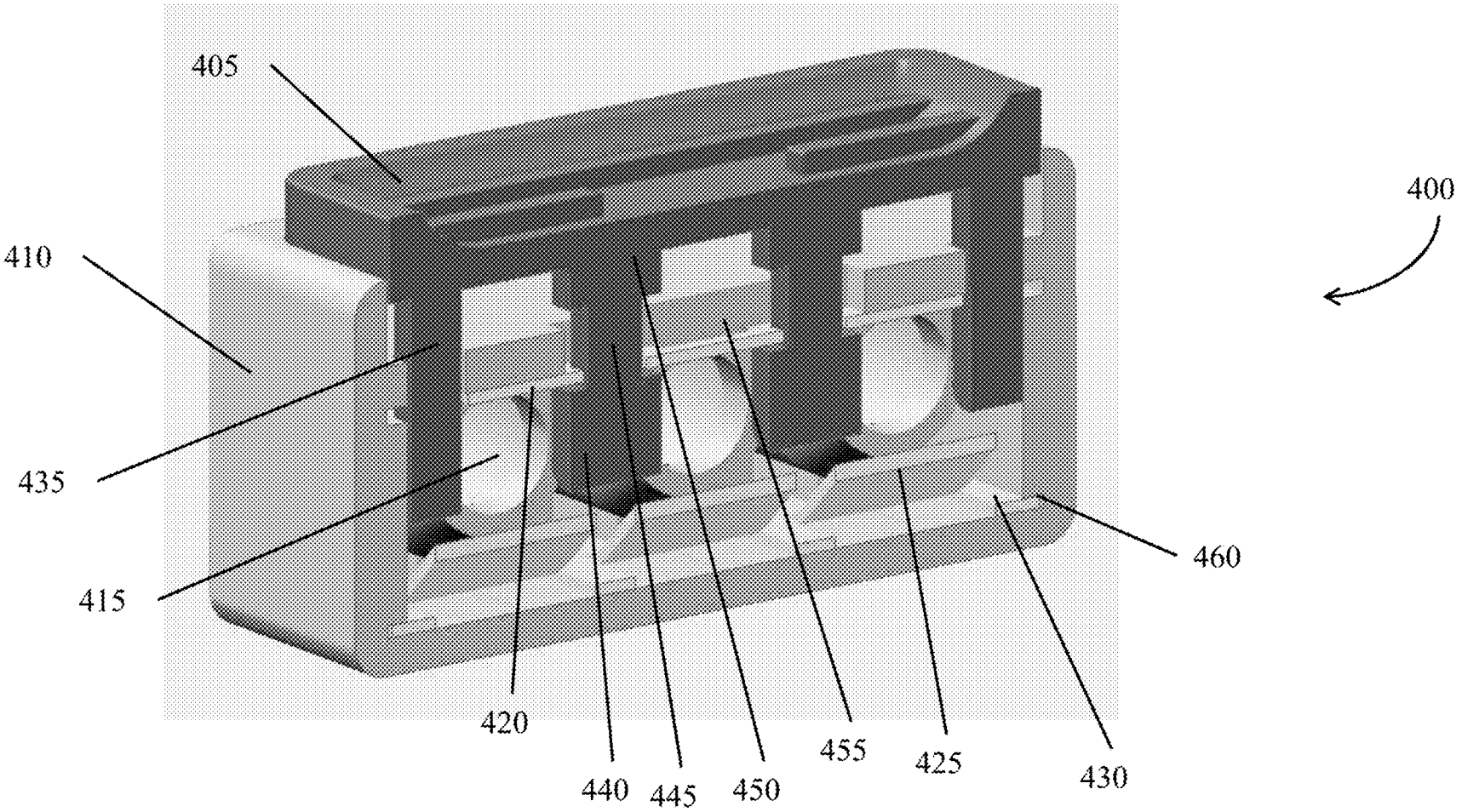
FIG. 4 depicts a cross-sectional perspective view of a push button power poke home connector in accordance with an illustrative embodiment.

In another illustrative example, FIG. 4 shows a perspective cross-sectional view of a connector 400 that utilizes a push button release. To better understand the view of FIG. 4, a cross-sectional line 360 is shown in FIG. 3. The cross-sectional line 360 shows the approximate location of where the connector 400 has been cross-sectional to demonstrate how the connector 400 operates inside.

The connector 400 includes a button 405, an insulated body 410, and a contact 430. The insulated body 410 includes an opening 415 through which a wire can be inserted. The button 405 includes a prong 435. As discussed previously (and more evident in this figure), the prong 435 is positioned between openings 415 and thus does not block the openings 415, allowing for a wire to be passed through the openings 415.

Another prong 450 is also part of the button 405. This prong 450 can move within a slot 455 in the insulated body 410. Further, the section at the top of prong 450 has a particular width. Extending down from that is a section 445 having a smaller width than the section at the top of prong 450. Further below the smaller width section 445 is a wider section 440. The smaller width section 445 fits in a groove in the contact 430. An upper portion 420 of the contact 430 has the groove which fits the smaller width section 445. The prong 450 can then move up and down within the groove. In this embodiment, the prong 450 only moves up and down the length of the smaller width section 445, as the upper section of prong 450 and the wider section 440 prevent the prong from moving within the groove past the smaller width section 445. This configuration limits how far the entire button 405 can move, and keeps the button 405 a part of the connector 400. As discussed with respect to FIG. 3, the prongs 435 and 450 can push down on an angled portion 425 of the contact 430. This may allow a wire to be easily inserted into the opening 415, and make it possible to easily remove a wire from the opening 415. To effectuate this, the prongs 435 and 450 press down on the angled portion 425 when the button 405 is depressed. When the button 405 is released, the angled portion 425 returns to a more upright position. If a wire is present when the button 405 is released, the angled portion 425 would press up against the wire to hold it in place against the upper portion 420 and provide electrical connectivity between the wire and the contact 430.

Additional features of the connector 400 can be observed from the embodiment shown in FIG. 4. It should be noted that the button 405 is shaped in a way that properly insulates and protects the contact 430 from outside interactions. For example, it the button 405 were not present, the contact 430 may be partially exposed through the openings, such as slot 455, that the prongs 435 and 450 extend through the insulated body 410. With the button 405 in place, the contact 430 is properly insulated to protect outside objects and persons from any current running through the contact 430.

Additionally, as shown in the embodiment in FIG. 4, the insulated body 410 may incorporate additional features to secure the contact 430 in place. For example, a groove 460 is shown. The groove 460 may accommodate and snugly fit the contact 430 in a way that secures the contact 430 into the insulated body 410. This may add extra safety to keep the contact from moving and causing faulty connections with wires inserted into the connector 400. Additionally, it may keep the contact 430 from moving when it is subjected to various forces, including depression of the button 405, removal of a wire, or insertion of a wire. This may contribute to the overall reliability and sturdiness of the connector 400.

Figure 5:
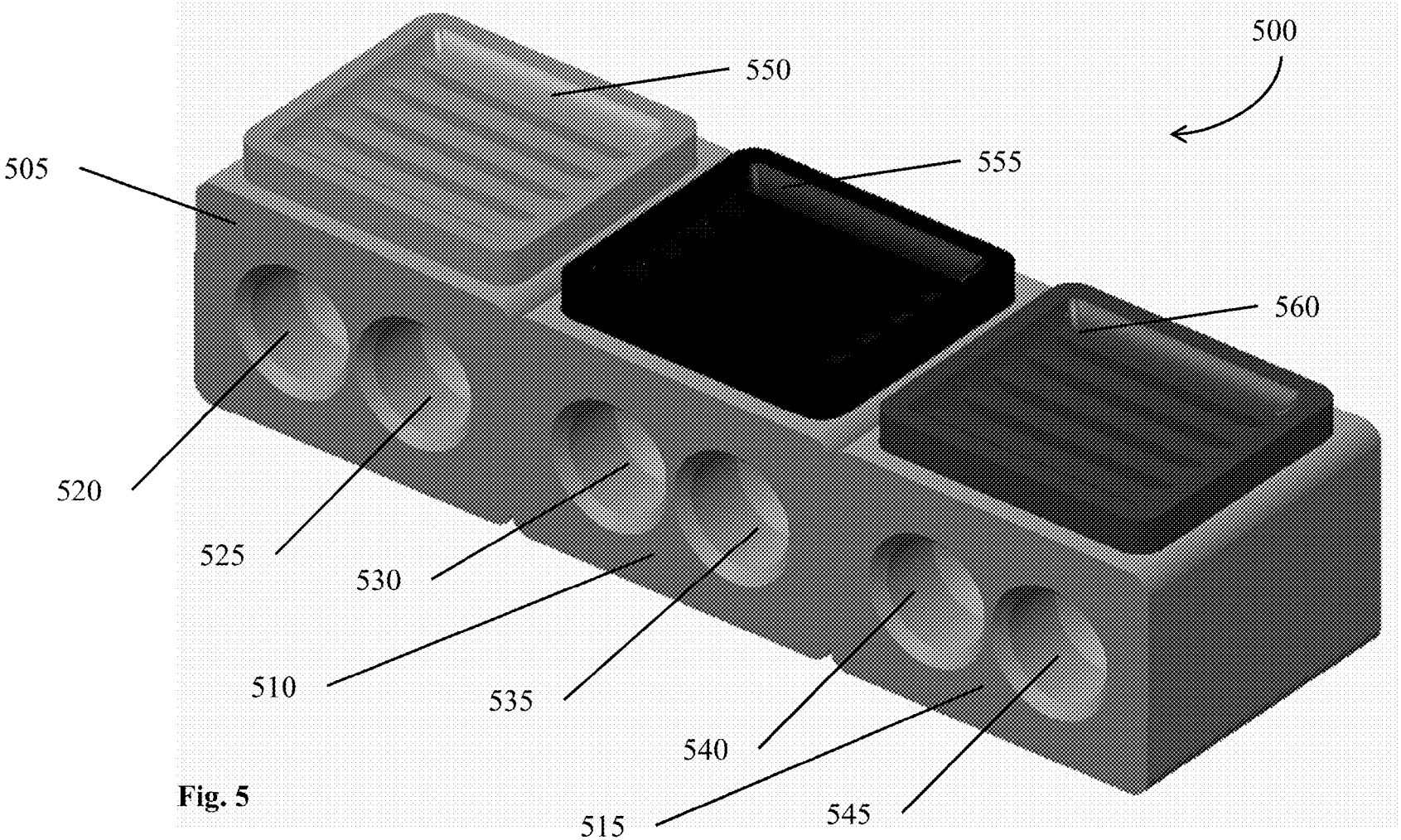
FIG. 5 depicts a perspective view of a multiple push button power poke home connector in accordance with an illustrative embodiment.

In another illustrative embodiment, FIG. 5 shows a perspective view of a multiple push button power poke home connector 500. In this embodiment, several different connectors are sold or packaged as one unit. Here, a first connector section 505 is provided, along with a second connector section 510 and a third connector section 515. In this embodiment, the first connector section 505 has two wire openings 520 and 525. If wires are inserted into the wire openings 520 and 525, they would be electrically connected by the first connector section 505.

Similarly, if wires are inserted into openings 530 and 535 in the second connector section 510, those two wires would be electrically connected. In the same manner, two wires inserted into openings 540 and 545 in the third connector section 515 would be electrically connected.

The configuration shown by connector 500 could be useful for wire connections of different, but related, types. For example, if wires of three different phases are being used, it may be useful to have a connector with three separate sections like connector 500, where one section could be used for each phase of the circuit. In another application, it may be useful to have a connector like the connector 500 where the three types of wires to run are a positive, a neutral, and a ground wire.

Additionally, the connector 500 may have a way of showing visually how the connector sections are defined. For example, they may be color coded. In one example, a button 550 of the first connector section 505 may be colored red to signal that the first connector section 505 is to be used for a "positive" wire. A button 555 may be colored black to signal that the second connector section 510 is to be used for a "neutral" wire. A button 560 may be colored green to signal that the third connector section 515 is to be used for a "ground" wire. Other embodiments may use the color blue to signify a "neutral" wire. A different embodiment may use the color brown to signify a "live" or "positive" wire.

It is contemplated by the current application that there can be many various embodiments and configurations of the connector 500. For example, each connector section 505, 510, and 515 may have three wire openings instead of two as shown. Each connector section may have even more than three openings in other embodiments. Further, each connector section may only have one opening. An example of where this may be used is if the connector is designed to connect multiple wires to a single electrical component. Additionally, other colors than the ones mentioned above may be used as identifiers for connectors or connector sections. The colors may be on other parts of the connector as opposed to the buttons. Symbols or alphanumeric characters may also be used to denote a connector or connector section for a particular use or purpose. Furthermore, the colors, symbols, or characters used to identify a connector or connector section may occur elsewhere on the connector than the buttons. In other embodiments, a connector may have more or fewer than three connector sections.

The different sections shown in FIG. 5 may also be packaged and/or connected in different ways. For example, the sections may be affixed together in one unit. In such an embodiment, the sections may be formed together, or they may be attached by an adhesive or other attaching mechanism. In a different embodiment, the different sections may only be packaged together, but are not actually attached to each other. In such an embodiment, the sections may still be designed for use in a related application, but are not attached to each other to allow flexibility both for accommodating various lengths of wires, small installation spaces, and aid ease of installation by a user.

Figures 6A, 6B, 6C, 6D:
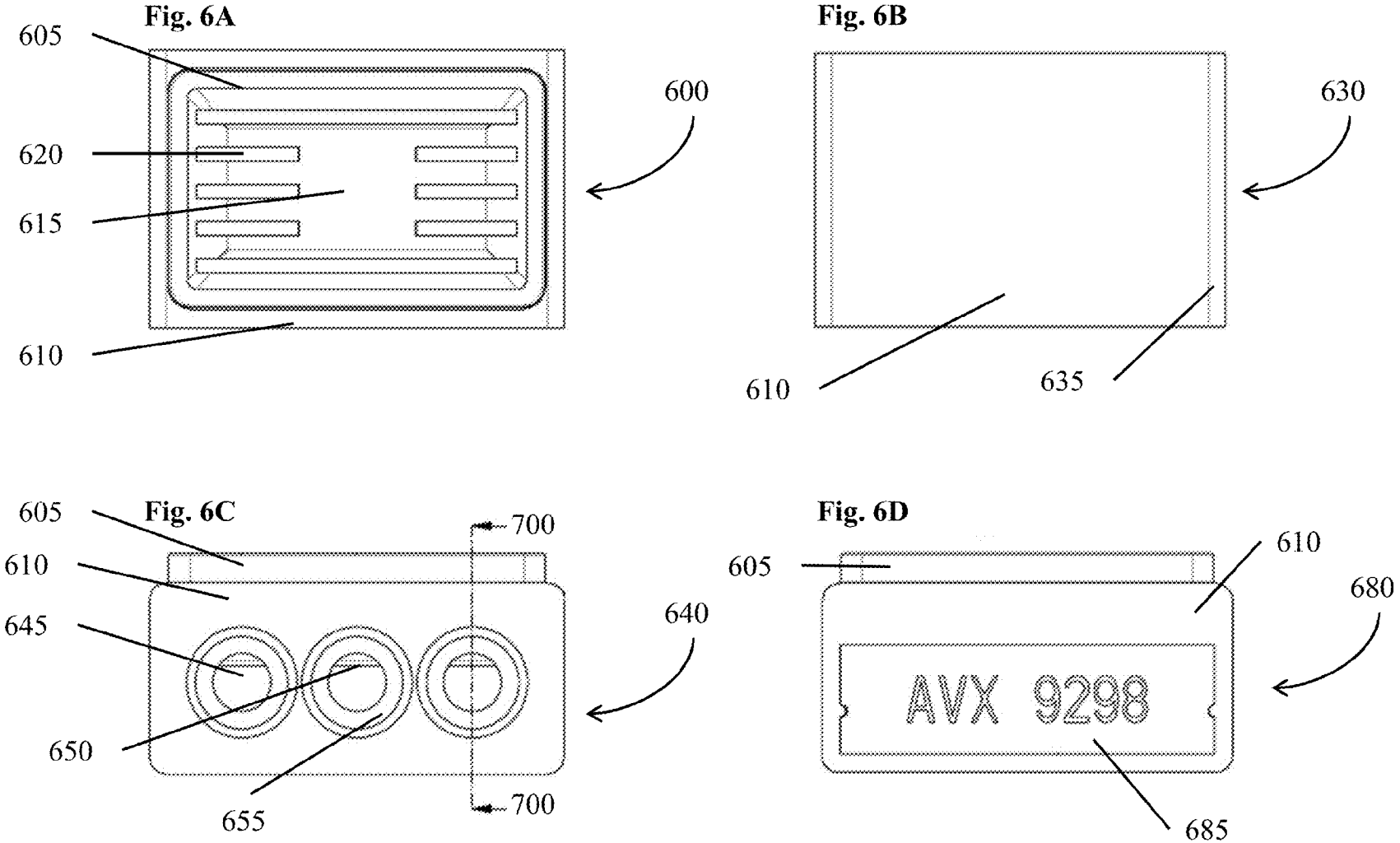
FIG. 6A depicts a top view of a push button power poke home connector in accordance with an illustrative embodiment.
FIG. 6B depicts a bottom view of a push button power poke home connector in accordance with an illustrative embodiment.
FIG. 6C depicts a front view of a push button power poke home connector in accordance with an illustrative embodiment.
FIG. 6D depicts a rear view of a push button power poke home connector in accordance with an illustrative embodiment.

In another illustrative embodiment, FIG. 6A shows a top view 600 of a push button power poke home connector. The view shows an insulated body 610 and a button 605. The button 605 includes ridges 620. The ridges 620 may allow better traction for when the button is pushed, preventing a finger from slipping off the button at an inopportune moment. The button 605 also includes an open space 615. The open space 615 may be a location suited for indicating what sort of wire is connected within the connector 600. A label could be affixed here, or to other parts of the connector. Further, the open space 615 may work along with the ridges 620 to provide a good surface for pushing the button 605 while preventing slippage.

FIG. 6B shows the bottom view 630 of a push button power poke home connector. The view shows the insulated body 610. In this embodiment, the insulated body has a beveled edge 635.

FIG. 6C shows the front view 640 of a push button power poke home connector. The view shows the button 605 and the insulated body 610. This view also show an opening 645 for a wire. Each opening also shows a reduced opening wall 655. This allows a wire with insulation to be inserted, where bare wire extends fully into the connector. Additionally visible from this view is a contact 650, which contacts any inserted wire and assists in holding such a wire in place. FIG. 6C also shows a cut-away line 700, which will be discussed with regard to FIG. 7 below.

FIG. 6D shows the rear view 680 of a push button power poke home connector. The view shows the button 605 and the insulated body 610. Additionally, this view shows a cap 685. The cap fits into an opening on the back of the insulated body 610. In this embodiment, the cap 685 includes writing signifying the part number of the manufacturer for this particular connector. In other embodiments, the cap 685 may have other writing, symbols, or labels on it, or may have nothing on it at all.

Figure 7:
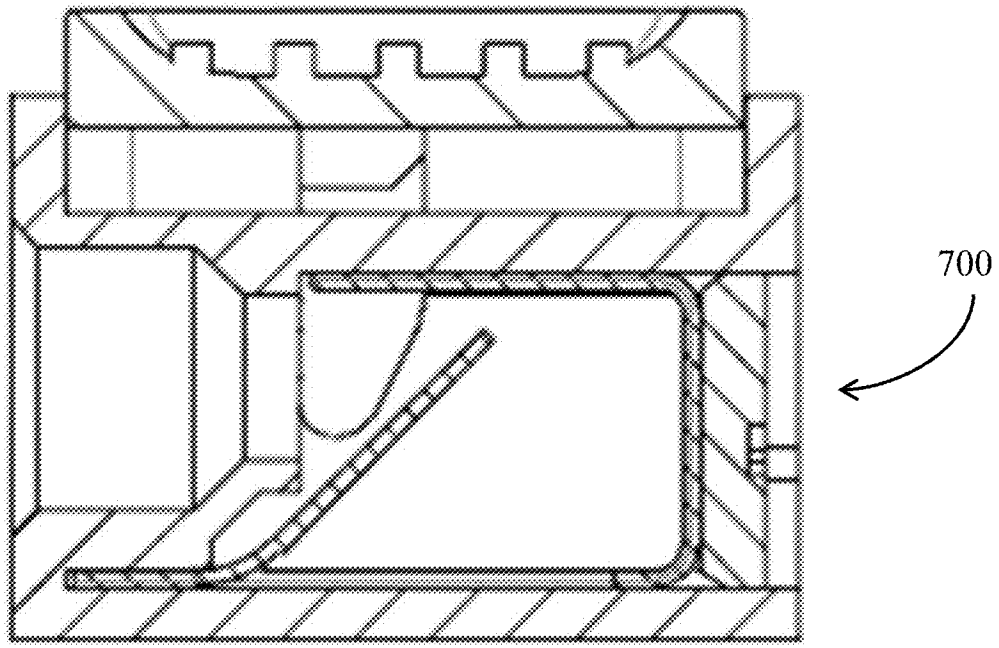
FIG. 7 depicts a cross-sectional view of the push button power poke home connector shown in FIG. 6C in accordance with an illustrative embodiment.

FIG. 7 shows the cross-sectional view 700 of a push button power poke home connector as demonstrated by cross-sectional line 700 in FIG. 6C. This view will not be discussed at length here, as it is similar to the cross-sectional view shown by FIG. 3 discussed above.

Figure 8A:
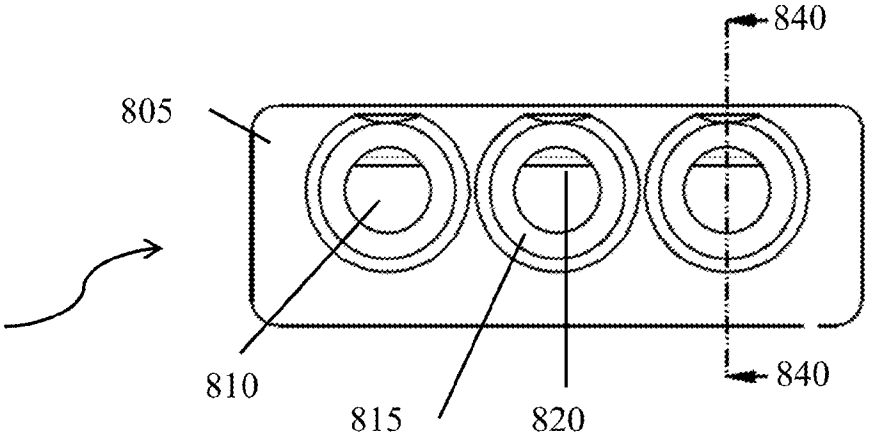
FIG. 8A is a front view of a power poke home connector in accordance with an illustrative embodiment.
Figure 8B:
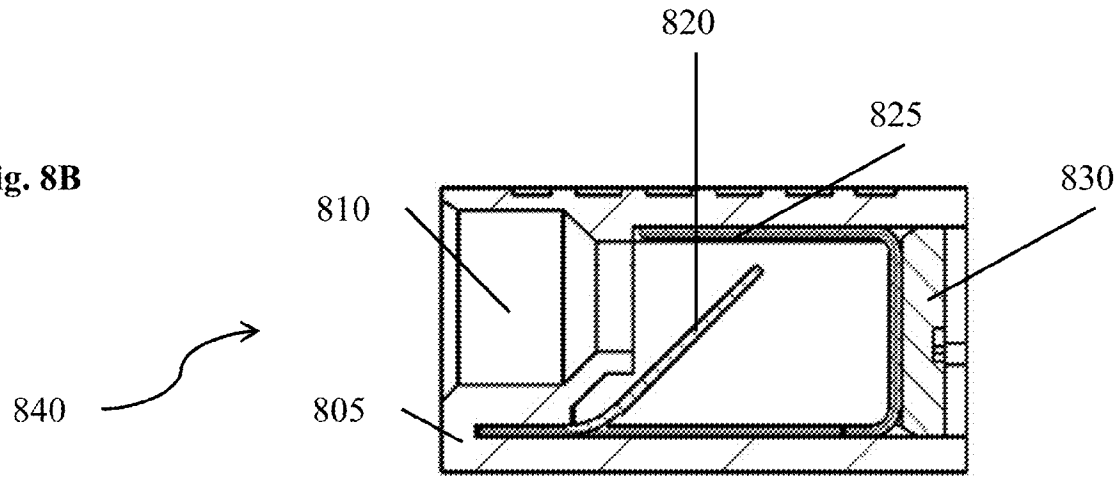
FIG. 8B depicts a cross-sectional view of the power poke home connector shown in FIG. 8A in accordance with an illustrative embodiment.

In another illustrative embodiment, FIGS. 8A and 8B show different views of a power poke home connector 800 without a push button release mechanism. FIG. 8A shows the front view of the power poke home connector 800. The power poke home connector 800 has an insulated body 805. The insulated body 805 includes an opening 810 for inserting a wire. The opening 810 has a reduced opening wall 815. This reduced opening wall 815 allows a wire with insulation to be inserted, where a bare wire extends fully into the connector. Additionally visible from this view is an angled portion 820 of a contact, which contacts any inserted wire and assists in holding such a wire in place.

A cross-sectional view line 840 is also shown in FIG. 8A. This line shows where the cross-sectional view 840 of FIG. 8B is. FIG. 8B shows the insulated body 805 and the opening 810. The view also demonstrates the angled portion 820 of the contact and an upper portion 825 of the contact. As with other embodiments, the angled portion 820 can exert a force on an inserted wire that presses the wire up against the upper portion 825. Because of the shape of the angled portion 820, a wire may be easily inserted into the connector 800. Since there is no push button release in this embodiment, removal of a wire from the connector 800 may require more force than some other embodiments. The connector 800 also has a cap 830 that fits into the back of the insulated body 805 and secures the contact in place.

In the aforementioned embodiments, the connectors could be fashioned to accommodate a variety of sizes and types of wires. Some embodiments may be made to accommodate a range of wire sizes and types. For example, one connector may be able to accommodate wires from a range of 18 AWG to 14 AWG. AWG refers to the American Wire Gauge sizes. Embodiments may accommodate various insulation thicknesses as well. For example, a connector that accommodates wire sizes of 18 AWG to 14 AWG may accommodate a maximum insulation up to 3.90 mm in diameter. Another embodiment may be sized to accommodate wires from 20 AWG to 12 AWG and accommodate insulation up to 4 mm in diameter.

The contacts of the aforementioned embodiments may be made of any suitable material for electrical conductivity. For example, one such contact may be made of 0.25 mm thick phosphor bronze, pre-tinned strip.

The insulated body, cap, and buttons of the aforementioned embodiments may be made from any suitable non-electrically conductive material. These materials are well known to those in the art, and may include a variety of plastics and other materials.

Connectors as disclosed herein may also be rated for a variety of applications. For example, some connectors may be rated for high power applications, while other connectors may be rated for low power. Other connectors may be rated for signal, control, or data type wiring. For example, one type of connector may have a nominal voltage rating of 300 Volts and a nominal current rating of 15 Amps.

It should be readily appreciated by those skilled in the art that various modifications and variations can be made to the embodiments of the invention illustrated and described herein without departing from the scope and spirit of the invention. The foregoing description of illustrative embodiments is not intended to be exhaustive or limiting with respect to the precise form disclosed, and modifications and variations are possible in light of the above teachings or may be acquired from practice of the disclosed embodiments. It is intended that such modifications and variations be encompassed by the appended claims.

What is claimed is:

1. An apparatus comprising:

an insulated body comprising an opening, wherein the insulated body is configured to receive a wire through the opening;

a conductive contact disposed in the insulated body, wherein the conductive contact is configured to:

contact the wire; and secure the wire through a compression force exerted on the wire; and a button disposed on the insulated body, wherein the button has a neutral position and a depressed position, and wherein the button in the depressed position is configured to reduce the compression force exerted on the wire; and wherein the button comprises a main portion and a prong portion, the at least one prong portion including:

a first prong section having a first width; and a second prong section extending from the first prong section, wherein the second prong section has a second width, and wherein the second width is greater than the first width, and wherein the conductive contact comprises a groove that is of a sufficient width to accommodate the first width of the first prong section, but wherein the sufficient width cannot accommodate the second width of the second prong section.

2. The apparatus of claim 1, wherein the insulated body is further configured to receive a second wire through a second opening in the insulated body.

3. The apparatus of claim 2, wherein the conductive contact is further configured to electrically connect the first wire and the second wire.

4. The apparatus of claim 1, wherein the conductive contact comprises an angled portion that depresses to a first depression when the wire is received through the opening, and further wherein the angled portion exerts the compression force on the wire by compressing the wire between the angled portion and a top portion of the conductive contact.

5. The apparatus of claim 4, wherein the button is further configured to depress the angled portion to a second depression, and wherein, at the second depression, a compression force is no longer exerted on the wire.

6. The apparatus of claim 1, wherein, when the button is in the neutral position, a portion of the button rests on the conductive contact.

7. The apparatus of claim 1, wherein the prong portion extends into the insulated body, but does not prevent a wire from being received into the insulated body through the opening.

8. The apparatus of claim 1, wherein the button is configured to move within the groove along the first prong section.

9. The apparatus of claim 1, wherein the opening comprises:

a first diameter at an outer surface of the insulated body; and a second diameter at a point inside the outer surface of the insulated body.

10. The apparatus of claim 1, wherein the button is configured to allow the insulated body to receive the wire when the button is in the neutral position or the depressed position, and further wherein the wire may be removed from the insulated body without the compression force exerted on the wire only when the button is in the depressed position.

11. An apparatus comprising:

an insulated body comprising an opening though which the insulated body is configured to receive a wire in an insertion direction;

a conductive contact disposed in the insulated body, wherein the conductive contact is configured to:

contact the wire;

secure the wire through a compression force exerted on the wire; and electrically connect the wire to an electrical component; and a button disposed on the insulated body, wherein the button has a neutral position and a depressed position, wherein the button in the depressed position is configured to reduce the compression force exerted on the wire, and wherein the button is configured to move from the neutral position to the depressed position in a direction perpendicular to the insertion direction.

12. The apparatus of claim 11, further comprising:

a second opening in the insulated body configured to receive a second wire in the insulated body, wherein the first wire is not electrically connected directly or indirectly to the second wire; and a second conductive contact disposed in the insulated body, wherein the conductive contact is configured to:

contact the second wire;

secure the second wire through a compression force exerted on the second wire; and electrically connect the second wire to a second electrical component.

13. The apparatus of claim 11, further comprising a second opening in the insulated body configured to receive a second wire in the insulated body, wherein the conductive contact comprises a single conductive piece that extends in front of both the first opening and the second opening such that the single conductor is further configured to electrically connect the first wire and the second wire upon insertion of the first wire and the second wire into the first opening and the second opening, respectively.

14. The apparatus of claim 11, wherein the button comprises a main portion positioned outside the insulated body and a prong portion extending within the insulated body, and wherein the prong portion extends within the insulated body in the direction perpendicular to the insertion direction.

* * * * *